US007597593B2

(12) United States Patent
Minich

(10) Patent No.: US 7,597,593 B2
(45) **Date of Patent: *Oct. 6, 2009**

(54) LEADFRAME ASSEMBLY STAGGERING FOR ELECTRICAL CONNECTORS

(75) Inventor: Steven E. Minich, York, PA (US)

(73) Assignee: FCI Americas Technology, Inc., Carson City, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/954,327

(22) Filed: Dec. 12, 2007

(65) Prior Publication Data

US 2008/0096436 A1 Apr. 24, 2008

Related U.S. Application Data

(63) Continuation of application No. 11/480,064, filed on Jun. 30, 2006, now Pat. No. 7,318,757.

(51) Int. Cl.
*H01R 13/502* (2006.01)

(52) U.S. Cl. ..... 439/701; 439/924.1

(58) Field of Classification Search ..... 439/701, 439/608, 79, 924.1

See application file for complete search history.

(56) References Cited

U.S. PATENT DOCUMENTS

| | | | |
|---|---|---|---|
| 4,687,267 | A | 8/1987 | Header et al. |
| 4,846,727 | A | 7/1989 | Glover et al. |
| 5,429,520 | A | 7/1995 | Morlion et al. |
| 5,586,915 | A | 12/1996 | Baker et al. |
| RE35,508 | E | 5/1997 | Lemke et al. |
| 5,822,849 | A | 10/1998 | Casali et al. |
| 5,993,259 | A | 11/1999 | Stokoe et al. |
| 6,071,152 | A | 6/2000 | Achammer et al. |
| 6,083,047 | A | 7/2000 | Paagman |
| 6,095,826 | A | 8/2000 | Potters |
| 6,171,149 | B1 | 1/2001 | Van Zanten |
| 6,312,287 | B1 | 11/2001 | Harting et al. |
| 6,371,773 | B1 | 4/2002 | Crofoot et al. |
| 6,390,857 | B1 | 5/2002 | Pickles et al. |
| 6,582,247 | B2 | 6/2003 | Siemon |
| 6,641,438 | B1 | 11/2003 | Billman et al. |
| 6,666,692 | B2 | 12/2003 | Billman et al. |
| 6,682,369 | B1 | 1/2004 | Korsunsky et al. |
| 6,712,646 | B2 | 3/2004 | Shindo |
| 6,746,278 | B2 | 6/2004 | Nelson et al. |
| 6,835,103 | B2 | 12/2004 | Middlehurst et al. |
| 6,843,686 | B2 | 1/2005 | Ohnishi et al. |
| 6,884,117 | B2 | 4/2005 | Korsunsky et al. |

(Continued)

FOREIGN PATENT DOCUMENTS

| | | | |
|---|---|---|---|
| EP | 1317023 | B1 | 7/2005 |

*Primary Examiner*—Neil Abrams
*Assistant Examiner*—Phuong Nguyen
(74) *Attorney, Agent, or Firm*—Woodcock Washburn LLP

(57) ABSTRACT

An electrical connector may include a connector housing and a plurality of identical leadframe assemblies received in the connector housing. Each of the leadframe assemblies may define a leadframe mating sequence. The leadframe assemblies may be arranged relative to one another to define a connector mating sequence that differs from the leadframe mating sequence. Each leadframe assembly may define a leadframe mounting footprint. The leadframe assemblies may be arranged relative to one another such that the leadframe mounting footprints are staggered, i.e., offset relative to one another.

20 Claims, 6 Drawing Sheets

U.S. PATENT DOCUMENTS

| | | | | |
|---|---|---|---|---|
| 6,890,214 | B2 | 5/2005 | Brown et al. | |
| 6,890,218 | B2 | 5/2005 | Patwardhan et al. | |
| 7,018,243 | B2 | 3/2006 | Guglhoer | |
| 7,083,432 | B2 | 8/2006 | Hull et al. | |
| 7,114,964 | B2 | 10/2006 | Winings et al. | |
| 7,195,519 | B1 * | 3/2007 | McAlonis et al. | 439/608 |
| 7,300,317 | B2 | 11/2007 | Dillon et al. | |
| 7,331,830 | B2 * | 2/2008 | Minich | 439/857 |
| 2004/0224559 | A1 | 11/2004 | Nelson et al. | |
| 2006/0035531 | A1 | 2/2006 | Ngo | |
| 2007/0207641 | A1 * | 9/2007 | Minich | 439/79 |

* cited by examiner

LEADFRAME ASSEMBLY STAGGERING FOR ELECTRICAL CONNECTORS

CROSS-REFERENCE TO RELATED APPLICATIONS

This application is a continuation of U.S. patent application Ser. No. 11/480,064, filed Jun. 30, 2006, the contents of which is incorporated by reference herein in its entirety. This application is related to U.S. patent application Ser. No. 11/480,045 filed on Jun. 30, 2006, and U.S. patent application Ser. No. 11/480,063 also filed on Jun. 30, 2006. The contents of each of the above-referenced applications is incorporated by reference herein in its entirety.

BACKGROUND OF THE INVENTION

Leadframe assemblies for electrical connectors are well-known. A typical leadframe assembly includes a dielectric leadframe housing and a plurality of electrical contacts extending therethrough. An insert-molded leadframe assembly (IMLA) may be manufactured according to a process wherein a leadframe is stamped from a sheet of electrically-conductive material, and a dielectric material is insert-molded over the leadframe.

Typically, the electrical contacts within a leadframe assembly are arranged into a linear array that extends along a direction along which the leadframe housing is elongated. The contacts may be arranged edge-to-edge along the direction along which the linear array extends. It may be desirable to form differential signal pairs wherein the contacts that form the pair are broadside-coupled (i.e., arranged such that the broadside of one contact faces the broadside of the other contact with which it forms the pair). Broadside or microstrip coupling is often desirable as a mechanism to control (e.g., minimize or eliminate) skew between the contacts that form the differential signal pair.

It is usually desirable to maintain a desired impedance between the contacts that form a differential signal pair, and to maintain a constant differential impedance profile along the lengths of the contacts of the differential signal pair from their mating ends to their mounting ends. It is often desirable for the mating of the contacts to be "sequenced." That is, it is often desirable for certain contacts to mate before, or after, others. Usually, to produce a connector that defines a multi-tiered mating sequence, contacts of different lengths are employed. The mating portions of longer contacts may extend farther in the mating direction that the mating portions of shorter contacts. For example, ground contacts may be made to extend farther in the mating direction than signal contacts so that the ground contacts mate first, thereby establishing a common ground between the connectors before any signal contacts mate.

The leadframe assemblies are typically inserted to the same depth relative to the mating face of the connector housing. Therefore, different leadframe assembly configurations may be required to produce certain desired mating sequences. For example, if a single contact in the connector is to be a "short detect pin," that contact would have to be shorter than any of the other contacts in the connector. The leadframe assembly containing the short detect pin could not, therefore, be identical to the other leadframe assemblies. This causes a need for different leadframe assemblies to be designed and manufactured. It would be desirable if a single leadframe assembly configuration could be used to produce a desired mating sequence.

SUMMARY OF THE INVENTION

An electrical connector may include a connector housing and a plurality of identical leadframe assemblies received in the connector housing. Each of the leadframe assemblies may define a leadframe mating sequence. The leadframe assemblies may be arranged relative to one another to define a connector mating sequence that differs from the leadframe mating sequence. For example, the leadframe mating sequence may be a two-tiered mating sequence (e.g., ground first then signal), while the connector mating sequence may have three tiers (e.g., ground first, then signal, and then short detect).

Such a leadframe assembly may include a leadframe housing that defines a mating face, and first and second electrical contacts that extend through the leadframe housing. A mating end of the first electrical contact may extend farther from the mating face of the leadframe housing than does a mating end of the second electrical contact. The first (longer) electrical contact of the first leadframe assembly may be a ground contact and the second (shorter) electrical contact of the first leadframe assembly may be a signal contact, while the first (longer) electrical contact of the second leadframe assembly may be a signal contact.

The mating end of the first electrical contact of the second leadframe assembly may extend beyond the mating face of the first leadframe assembly housing as far as does the second electrical contact of the first leadframe assembly. Accordingly, the first contact of the first leadframe assembly may make contact in the first tier of the mating sequence, while the second contact of the first leadframe assembly and the first contact of the second leadframe assembly may make contact in the second tier of the mating sequence. The mating ends of the first and second electrical contacts of the first leadframe assembly may extend farther beyond the mating face of the first leadframe assembly housing far than does the mating end of second electrical contact of the second leadframe assembly. Accordingly, the second electrical contact of the second leadframe assembly may make contact in the third tier of the mating sequence.

A housing for such an electrical connector may include a body portion that defines a mating face, a receiving face opposite the mating face, a first cavity extending from the receiving face to the mating face, and a second cavity extending from the receiving face to the mating face. Each cavity may be adapted to receive a respective leadframe assembly, each of which defines a leadframe mating sequence. Each cavity may include a respective dovetail receptacle that is adapted to receive a dovetail defined by the leadframe assembly the cavity is adapted to receive. The leadframe assemblies may be identical to one another.

The body portion may define a structure that is adapted to contain at least the first leadframe assembly such that, when both of the leadframe assemblies are received into the respective cavities, the leadframe assemblies are arranged relative to one another to define a connector mating sequence that differs from the leadframe mating sequence. The structure may include a protrusion extending from the receiving face of the body portion of the housing. The protrusion may be adapted to prevent the first leadframe assembly from extending as far beyond the mating face of the housing as does the second leadframe assembly. The protrusion may define a receiving face that is adapted to prevent the first leadframe assembly from moving into the first cavity. The first cavity may extend through the protrusion, from the receiving face of the protrusion to the mating face of the housing.

An electrical connector may include first and second leadframe assemblies received in a connector housing, wherein each leadframe assembly defines a leadframe mounting footprint. The leadframe assemblies may be arranged relative to one another such that the leadframe mounting footprints are staggered, i.e., offset relative to one another. Each of the leadframe assemblies may include a respective leadframe housing and a respective plurality of electrical contacts extending through the leadframe housing. Each of the contacts may have a mating end and a mounting end. The mounting ends may be adapted to be received onto a substrate in a mounting direction. The mating ends may be adapted to be received by complementary contacts in a mating direction. The leadframe mounting footprints may be offset relative to one another in the mating direction. The mating direction may be perpendicular to the mounting direction. Each of the mounting footprints may define a row pitch. The mounting footprints may be offset relative to one another by a row pitch or less.

DETAILED DESCRIPTION OF ILLUSTRATIVE EMBODIMENTS

Figure 1B:
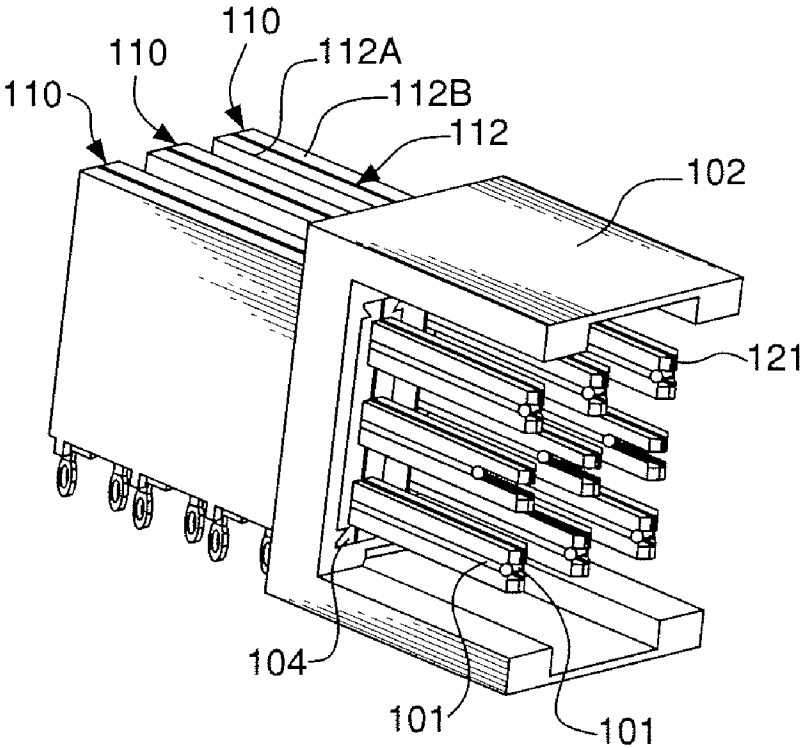
FIGS. 1A and 1B are isometric views of a first example embodiment of an electrical connector.
Figure 1A:
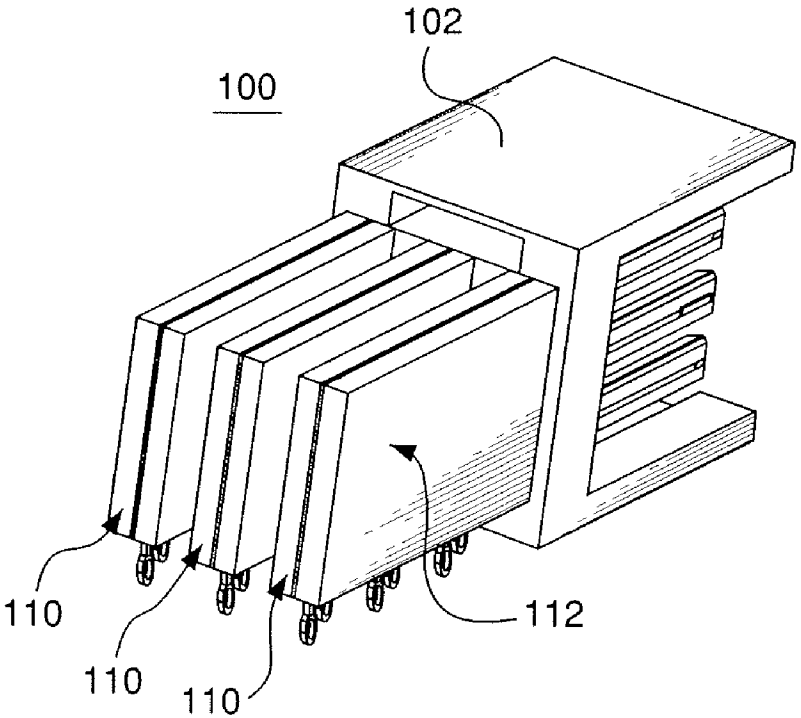

FIGS. 1A and 1B are isometric views of an example connector 100 having a plurality of leadframe assemblies 110 and a connector housing 102. The connector housing 102 may be made of a dielectric material, such as a plastic, for example. Though the connector 100 is shown with three leadframe assemblies 110, it should be understood that the connector may include any number of leadframe assemblies 110. Each leadframe assembly 110 may include a leadframe housing 112, which may be made of a dielectric material, such as a plastic, for example. Pairs of electrically conductive contacts 101 may extend through the leadframe housing 112.

Each leadframe assembly 110 may include a first linear array of electrical contacts extending along a first imaginary line, and a second linear array of electrical contacts extending along a second imaginary line that is parallel to the first imaginary line. The contacts 101 may be arranged into differential signal pairs. Each pair may be positioned along an imaginary line that is generally perpendicular to the imaginary lines along which the linear arrays extend. Stated another way, the contacts within each pair are positioned side-to-side. Each linear array may be referred to herein as a contact column. A contact row may be said to extend perpendicular to the contact columns. Accordingly, the connector 100 depicted in FIGS. 1A and 1B may be said to include six columns and three rows of electrical contacts. Though each leadframe assembly 110 is shown to include three pairs of contacts 101, it should be understood that each leadframe assembly 110 may include any number of contacts 101.

A first column of electrical contacts may extend through a first portion 112A of the leadframe housing 112. A second column of electrical contacts may extend through a second portion 112B of the leadframe housing 112. The first portion 112A and the second portion 112B of the leadframe housing 112 may be connected via a hinge 121 defined by the leadframe housing 112. The first portion 112A and the second portion 112B may be otherwise unconnected.

Figure 2:
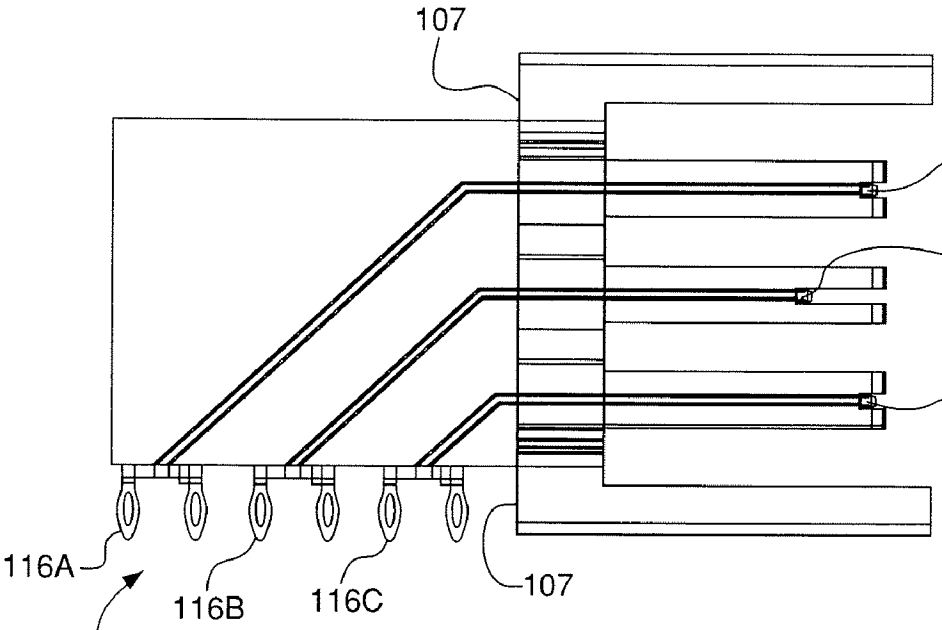
FIG. 2 is a cross-sectional view of the first example electrical connector embodiment.

As best seen in FIG. 2, the connector 100 may define a mounting side 106 and a mating side 108. The connector 100 may be a right-angle connector, as shown, wherein the plane defined by the mounting side 106 is generally perpendicular to the plane defined by the mating side 108. It should be understood, however, that the principles of the invention could be applied to a mezzanine-style connector, wherein the plane defined by the mounting side is generally parallel to the plane defined by the mating side.

Each of the electrical contacts may define a respective mounting end 116A-C and a respective mating end 118A-C. The mounting ends 116A-C may be compliant ends, as shown, though it should be understood that the mounting ends 116A-C may be any press-fit, through-mount, or surface-mount tail end. Each of the mounting ends 116A-C may include a respective fusible mounting element (not shown), such as a solder ball, for example. The mating ends 118A-C may be gold-plated.

Figure 3:
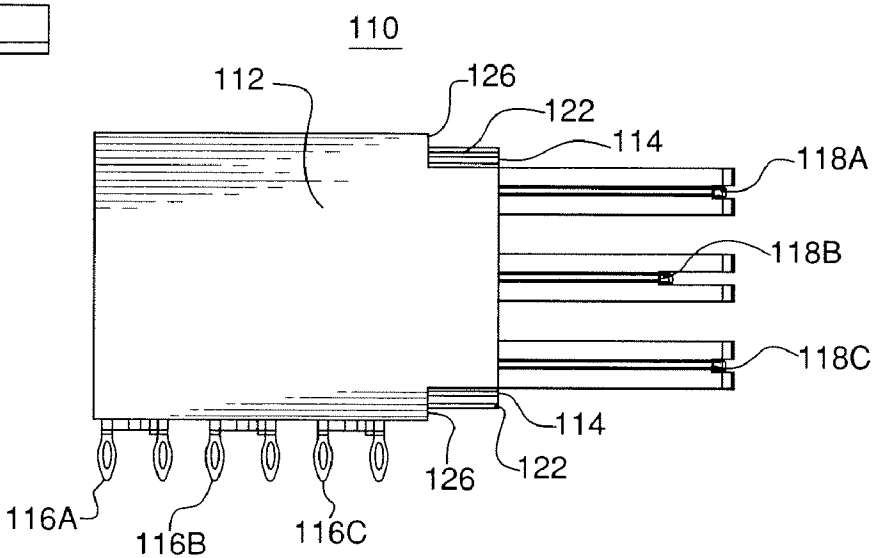
FIG. 3 is a side view of an example embodiment of a leadframe assembly.

FIG. 3 is a side view of an example leadframe assembly 110. The leadframe housing 112 may define one or more dovetails 122. Each such dovetail 122 may be a split dovetail. That is, a first portion of the leadframe housing 112 may include a first portion (preferably half) of the dovetail 122. A second portion of the leadframe housing 112 may include a second portion (also preferably half) of the dovetail 122. The leadframe housing 112 may include a first dovetail 122 positioned proximate a first (e.g., upper) end of the leadframe assembly 110, and a second dovetail 122 positioned proximate a second, opposite (e.g., lower) end of the leadframe assembly 110. As shown in FIG. 1B, the connector housing 102 may define one or more dovetail receptacles 104 that are complementary to the one or more dovetails 122. That is, the dovetail receptacles 104 may be positioned, sized, and shaped to receive a corresponding dovetail 122. Each dovetail 122 may include one or more protrusions that allow for some flexibility in the size and shape of the dovetail receptacles 104. Thus, the dovetail receptacles 104 do not have to be exact complements of the dovetails 122.

The leadframe housing 112 may also define one or more stops 126 that, when the leadframe housing 112 is fully seated in the connector housing 102, abut a receiving face 107 defined by the connector housing 102. Thus, the leadframe assembly 110 may be prevented from moving beyond a certain point in the mating direction (i.e., the direction in which the connector 100 moves during mating relative to the receptacle connector; the direction shown by the arrow in FIG. 2).

As shown, the mating end 118B of the middle contact may not extend as far in the mating direction as do the mating ends 118A, 118C of the top and bottom contacts. In other words, the mating ends 118A, 118C of the top and bottom contacts are farther from the mating face 114 of the leadframe housing 112 than the mating end 118B of the middle contact. Thus, the middle contact does not extend as far from the mating face 114 of the leadframe housing 112 as do the top and bottom contacts. Looked at another way, the hinge 121 (see FIG. 1B) of the leadframe housing 112 extends farther from the mating end 118B of the middle contact than it does beyond the mating ends 118A, 118C of the top and bottom contacts. That is, the mating end 118B of the middle contact is recessed farther behind the hinge 121 of the leadframe housing 112 than are the mating ends 118A, 188C of the top and bottom contacts.

The leadframes in each of the several leadframe assemblies may be identical. Accordingly, the leadframe assemblies may be referred to herein as "identical" leadframe assemblies, even if certain, irrelevant aspects of the leadframe assemblies are not, strictly speaking, identical. Each leadframe assembly defines a two-tiered mating sequence. That is, as the leadframe assembly is mated, the top and bottom contact pairs mate at roughly the same time (first tier), and then the middle contact pair mates (second tier). In general, the leadframe assemblies have two tier mating among signal pairs and perhaps between ground contacts and signal pairs.

As the connector is mated, all the top and bottom contact pairs of all the leadframe assemblies mate at roughly the same time (first tier). Then, all the middle contact pairs of all the leadframe assemblies mate at roughly the same time (second tier). Thus, the connector also defines a two-tiered connector sequence. Accordingly, the connector mating sequence is defined to be the same as the leadframe mating sequence.

Figure 5:
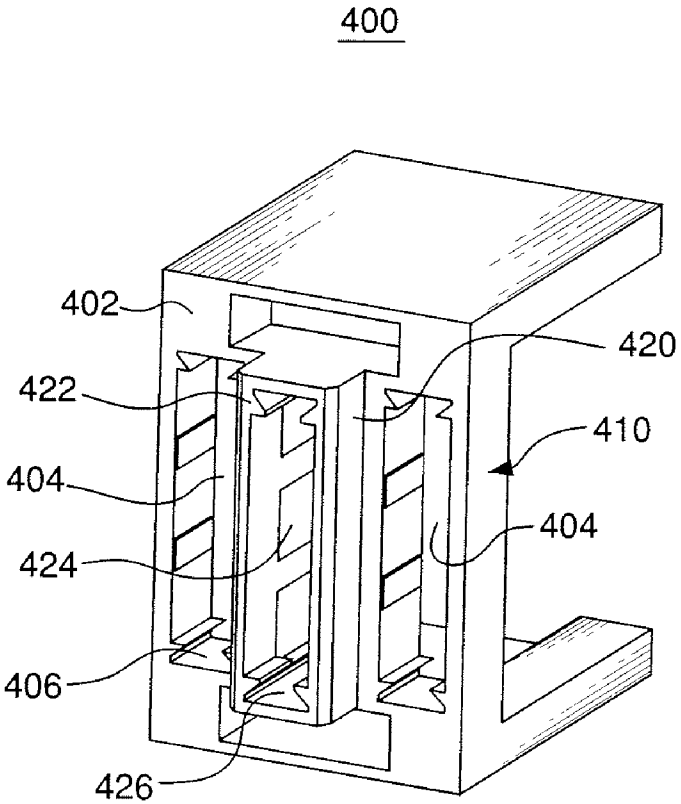
FIGS. 4 and 5 are isometric views of example embodiments of connector housings.
Figure 4:
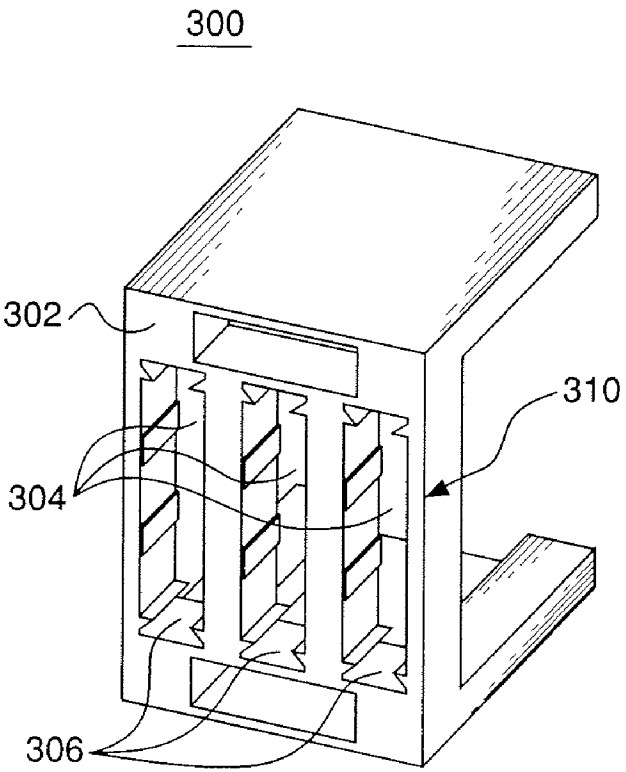

FIGS. 4 and 5 are isometric views of example embodiments of connector housings. FIG. 4 depicts an example embodiment of a connector housing 300 that is adapted to receive three leadframe assemblies. As described above, such a connector housing may receive three identical leadframe assemblies, where each of the leadframe assemblies defines a leadframe mating sequence. Accordingly, the connector will define a connector mating sequence that is the same as the leadframe mating sequence.

As shown, the connector housing 300 may have a body portion 310 that defines a receiving face 302, a mating face (not seen in FIG. 4) opposite the receiving face 302, and a plurality of cavities 304 extending from the receiving face 302 to the mating face. Each cavity 304 may be adapted to receive a respective leadframe assembly, and may include one or more dovetail receptacles 306 that are adapted to receive dovetails defined by the leadframe assembly housing 112.

The cavities 304 may be defined such that the leadframe assemblies 110 may be received in the mating direction, until each leadframe assembly is stopped by the receiving face 302. The receiving face 302 of the connector housing 300 may be adapted to prevent the leadframe assemblies from moving, beyond a certain point, in the mating direction, into the cavities 304. Thus, where the leadframe assemblies are identical, the receiving face 302 may cause all of the leadframe assemblies to extend the same distance beyond the mating face of the connector housing 300. Accordingly, with identical leadframe assemblies (each defining the same leadframe mating sequence), the connector mating sequence may be identical to the leadframe mating sequence.

FIG. 5 depicts another example embodiment of a connector housing 400 that is adapted to receive three leadframe assemblies 110. Such a connector housing may receive three identical leadframe assemblies 110, where each of the leadframe assemblies 110 defines a leadframe mating sequence. As will be described below, a connector employing such a connector housing may define a connector mating sequence that is different from the leadframe mating sequence. Thus, by employing an appropriately-constructed connector housing, a plurality of identical leadframe assemblies may be used to define any number of different connector mating sequences. Such an approach tends to minimize the impact on manufacturing because the connector mating sequence can be changed by changing only the housing or a preset insertion depth of the leadframe assemblies 110 into the housing.

As shown, the connector housing 400 may have a body portion 410 that defines a receiving face 402, a mating face (not seen in FIG. 5) opposite the receiving face 402, and a plurality of cavities 404 extending from the receiving face 402 to the mating face. Each cavity 404 may be adapted to receive a respective leadframe assembly 110, and may include one or more dovetail receptacles 406 that are adapted to receive one or more complementary dovetails defined by the leadframe assembly 110.

The cavities 404 may be defined such that respective leadframe assemblies 110 may be received in the mating direction, until each leadframe assembly is stopped by the receiving face 402 of the connector housing 400. The receiving face 402 may be adapted to prevent the leadframe assemblies 110 from moving, beyond a certain point, into the cavities 404. That is, the receiving face 402 may be adapted to prevent the leadframe assemblies 110 from moving, beyond a certain point, in the mating direction. Thus, where the leadframe assemblies are identical, the receiving face 402 of the connector housing 400 may cause the leadframe assemblies received in the cavities 404 all to extend the same distance beyond the mating face of the connector housing 400.

The housing 400 may include a protrusion 420 extending from the receiving face 402 of the body portion 410. The protrusion 420 may be adapted to cause one or more of the leadframe assemblies to be staggered, in the mating direction, relative to one or more of the others. For example, as shown in FIG. 5, the protrusion 420 may define a receiving face 422 and a cavity 424 that extends from the receiving face 422 defined by the protrusion to the mating face of the housing. The cavity 424 may include one or more dovetail receptacles 426 that are adapted to receive one or more complementary dovetails defined by the leadframe assembly.

The cavity 424 may be defined such that a leadframe assembly may be received in the mating direction, until it is stopped by the receiving face 422 of the protrusion 420. The receiving face 422 may be adapted to prevent a leadframe assembly received in the cavity 424 from moving, beyond a certain point, into the cavity 424. That is, the receiving face 422, dovetails, or dovetail slots may be adapted to prevent a leadframe assembly received in the cavity 424 from moving, beyond a certain point, in the mating direction. Thus, the receiving face 422 of the protrusion 420 may prevent the leadframe assembly received in the cavity 424 from extending as far beyond the mating face of the connector housing 400 as do the leadframe assemblies received in the cavities 404. Thus, the protrusion 420 may cause the leadframe assembly received in the cavity 424 to be offset in the mating direction, relative to the leadframe assemblies received in the cavities 404. That is, the protrusion 420 may cause the leadframes to be staggered in the mating direction.

FIGS. 6A-6D provide various views of an example connector 500 having a plurality of leadframe assemblies 510A-C contained by a connector housing 400. Each of the leadframe assemblies 510A-C is received in a respective cavity defined by the housing 400. As shown, the housing of the middle leadframe assembly 510B abuts the receiving face 422 of the protrusion 420, while the housings of the adjacent leadframe assemblies 510A and 510C abut the receiving face of the connector housing. Consequently, the mating end of the leadframe assembly 510B does not extend as far from the mating face or rear surface of the leadframe assemblies 510A or 510B of the connector housing as do the mating ends of the leadframe assemblies 510A and 510B.

Figure 6B:
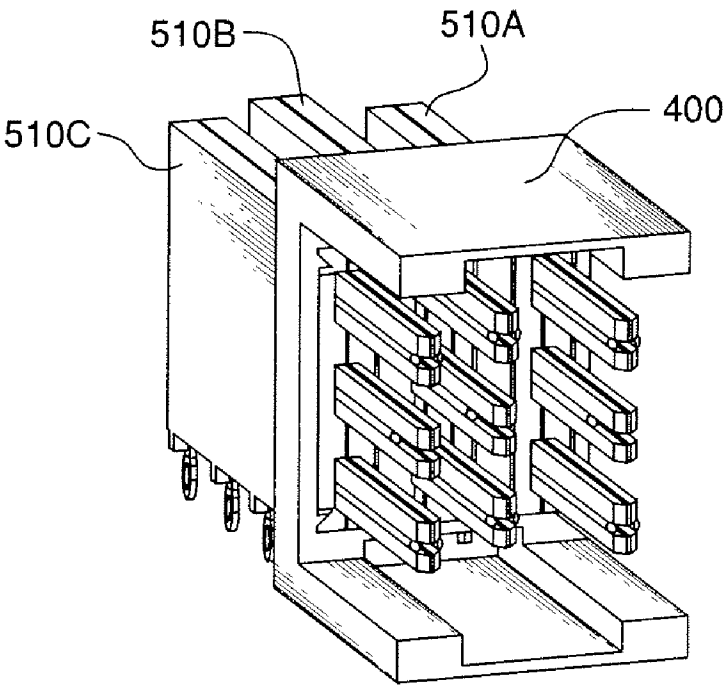
FIGS. 6A-6D are various views of a second example embodiment of an electrical connector.
Figure 6A:
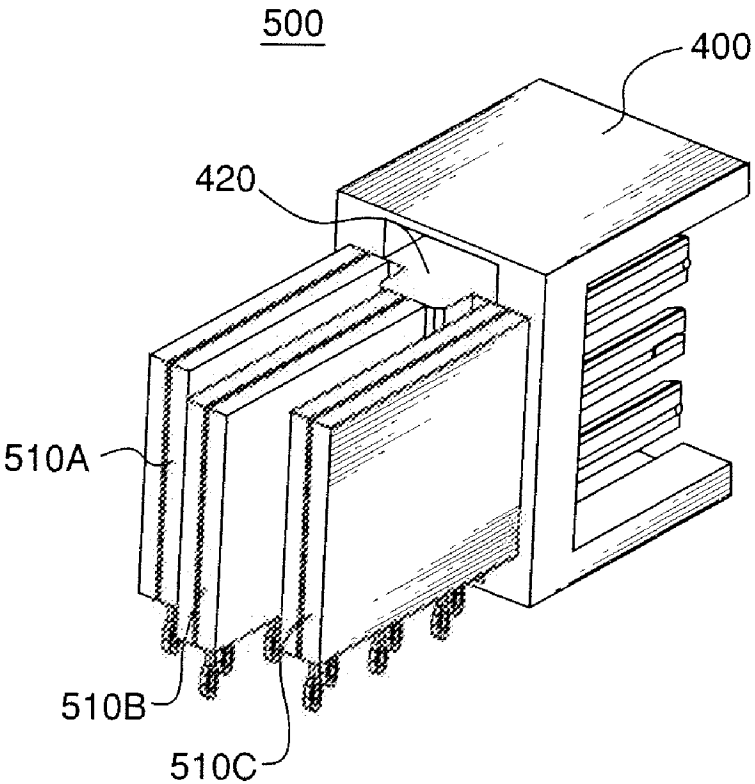
Figure 6C:
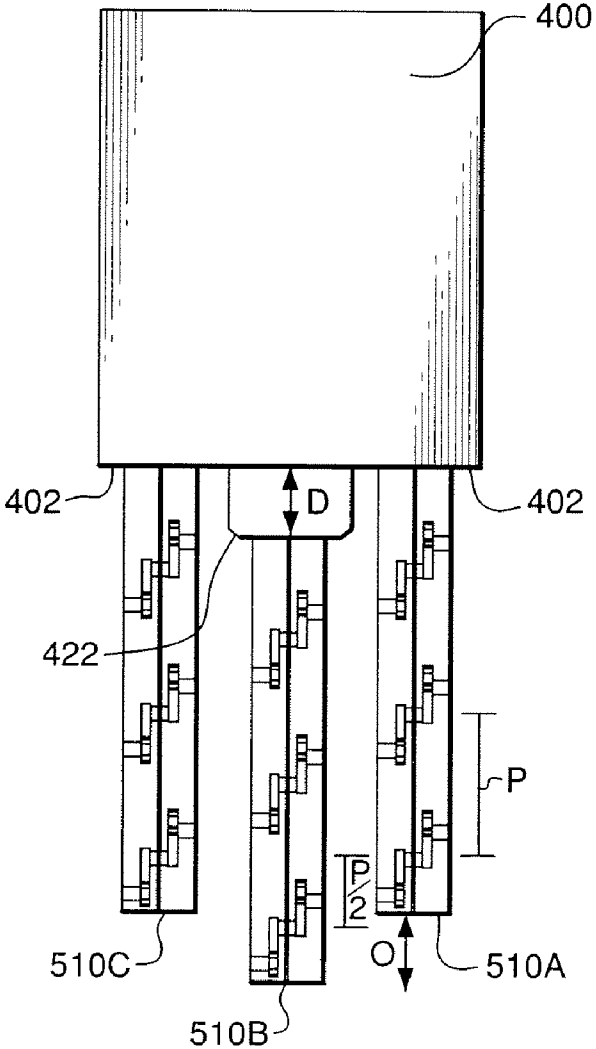

As best seen in FIG. 6C, the protrusion may cause the connector footprint to be staggered. That is, one of the leadframe assemblies (e.g., the middle leadframe assembly as shown) may be offset in the mating direction (e.g., the y-direction as shown) relative to an adjacent leadframe assembly (e.g., the left or right leadframe assembly as shown). The protrusion may cause the leadframe assembly that is received into the cavity in the protrusion to be offset in the mating direction relative to the adjacent leadframe assemblies.

The footprint of each leadframe assembly may define a pair pitch P. The term "pair pitch," as used herein, refers to the distance between the centers of the mounting ends of adjacent pairs, as measured along the mating direction. A leadframe assembly may be offset from an adjacent leadframe assembly by any amount. The amount of offset may be chosen to cause cross-talk among the differential signal pairs to be limited to below a desired level such as six percent or less. The offset O may be defined by the distance D that the protrusion extends from the receiving face of the connector housing. For example, the offset O may be equal to the distance D. The offset O may be a pair pitch P or less. For example, the offset O may be half a pair pitch (P/2).

Figure 6D:
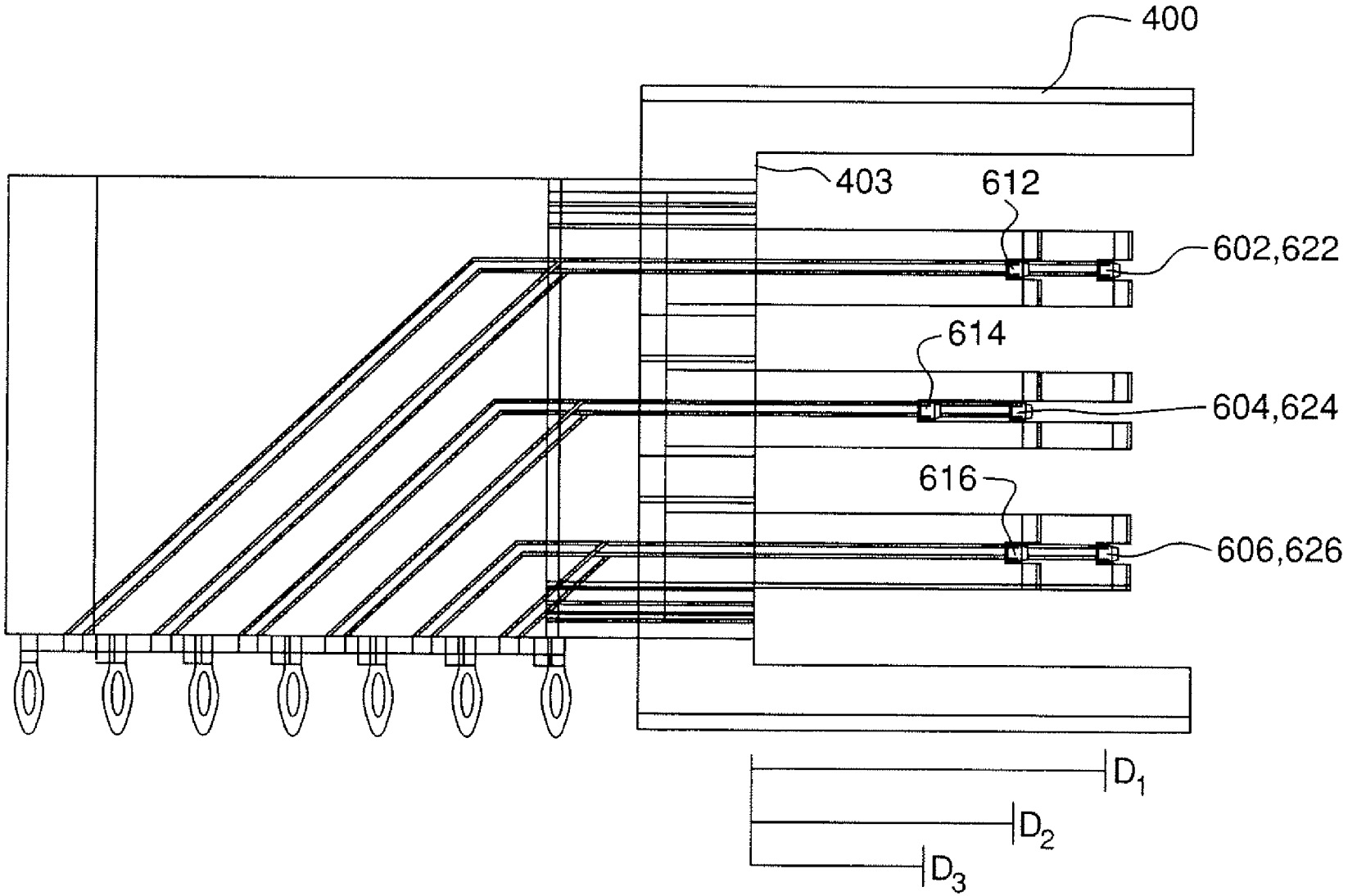

As best seen in FIG. 6D, a plurality of identical leadframe assemblies, each defining a one or two-tiered mating sequence, can be arranged relative to one another such that the connector may define a two- or three-tiered connector mating sequence. Mating portions of the top contacts 602, 622 and bottom contacts 606, 626 of the left leadframe assembly 510A and right leadframe assembly 510C each extends a first distance, $D_1$, from the mating face 403 of the connector housing 400. Thus, the mating ends of the top and bottom contacts of the left and right leadframe assemblies extend to first line. Mating portions of the middle contacts 604, 624 of the left leadframe assembly 510A and right leadframe assembly 510C each extends a second distance, $D_2$, from the mating face 403 of the connector housing 400. Accordingly, the mating ends of the middle contacts 604, 624 are set back from the mating ends of the top and bottom contacts by a distance $D_1$- $D_2$. Thus, the mating ends of the middle contacts of the left and right leadframe assemblies extend to second line that is separated from first line by a distance $D_1$-$D_2$.

The protrusion 420 may extend the same distance, $D_1$-$D_2$, from the receiving face 402 of the connector housing 400. That is, the distance D between the receiving face 422 of the protrusion 420 and the receiving face 402 of the connector housing 400 is about the same as the distance $D_1$-$D_2$ that the middle contact is set back from the mating ends of the top and bottom contacts (e.g., $D=D_1-D_2$). Consequently, the mating ends of the top contact 612 and bottom contact 616 of the middle leadframe assembly 510B extend to the second line, i.e., to the same line as do the mating ends of the middle contacts 604, 624 of the left and right leadframe assemblies 510A, 510C. The mating portion of the middle contact 614 of the middle leadframe assembly 510B extends a third distance, $D_3$, from the mating face 403 of the connector housing 400. Accordingly, the mating end of the middle contact 614 of the middle leadframe assembly 510B extends to a third line, which is set back from the second line by a distance $D_2$-$D_3$.

When the connector 500 is mated with a complementary receptacle connector (not shown), the contacts having mating ends extending to the first line will mate first, contacts having mating ends extending to the second line will mate second, and contacts having mating ends extending to the third line will mate third. Thus, a two-tiered leadframe mating sequence can be converted into a three-tiered connector mating sequence, using identical leadframe assemblies.

It should be understood that the body portion may define any structure that is adapted to contain one or more of the leadframe assemblies such that, when the leadframe assemblies are received into the respective cavities, the leadframe assemblies are arranged relative to one another to define a connector mating sequence that differs from the leadframe mating sequence. For example, the cavities may include stops that prevent the leadframe assemblies from moving beyond a certain point in the mating direction. Different cavities may have the stops at different places, so that some leadframe assemblies are allowed to go farther into the cavities that receive them than are others.

Other embodiments are also contemplated. For example, the leadframe housings could be altered to include stops that prevent the leadframe assemblies from moving beyond a certain point in the mating direction. Different leadframe assemblies may have the stops at different places, so that some leadframe assemblies are allowed to go farther into the cavities that receive them than are others would extend different distances through the connector housing. In another embodiment, the leadframe assemblies could simply be inserted more or less into the connector housing in order to define any desired mating sequence. In such an embodiment, no mechanical stop would be necessary. The leadframe assembly housing could have a protrusion, and the connector housing could have a receptacle positioned such that the leadframe assembly is inserted into the housing, the protrusion engages the receptacle and prevents the leadframe assembly from moving at least in the mating direction. A retainer may be employed. The ends of the leadframe housing opposite the mating ends could be inserted into the retainer, which may be designed to hold the leadframe assemblies in a staggered relationship.

What is claimed:

1. An electrical connector, comprising:

a connector housing;

a first leadframe assembly received in the connector housing; and a second leadframe assembly received in the connector housing, wherein, (i) the first leadframe assembly defines an identical leadframe mating sequence with respect to the second leadframe assembly, and (ii) the first and second leadframe assemblies are arranged relative to one another to define at least in part, a connector mating sequence that differs from the leadframe mating sequence.

2. The electrical connector of claim 1, wherein the leadframe mating sequence has at least two tiers and the connector mating sequence has at least three tiers.

3. The electrical connector of claim 1, wherein the leadframe mating sequence has two tiers and the connector mating sequence has three tiers.

4. The electrical connector of claim 1, wherein the connector housing includes a structure that is adapted to offset the first leadframe assembly from the second leadframe assembly.

5. The electrical connector of claim 4, wherein the structure includes a protrusion extending from the connector housing, the protrusion being adapted to prevent the first leadframe assembly from extending as far into the connector housing as the second leadframe assembly.

6. The electrical connector of claim 1, wherein the first leadframe assembly includes a first leadframe housing that defines a mating face and first and second electrical contacts that extend through the first leadframe housing, and wherein a mating end of the first electrical contact extends farther from the mating face of the first leadframe housing than does a mating end of the second electrical contact.

7. The electrical connector of claim 6, wherein the second leadframe assembly includes a second leadframe housing that defines a mating face and third and fourth electrical contacts that extend through the second leadframe housing, and wherein a mating end of the third electrical contact extends farther from the mating face of the second leadframe housing than does a mating end of the fourth electrical contact.

8. The electrical connector of claim 7, (i) wherein the first electrical contact is a ground contact and the second electrical contact is a signal contact, and (ii) the third electrical contact is a signal contact.

9. The electrical connector of claim 8, wherein the mating end of the third electrical contact extends beyond the mating face of the first leadframe assembly housing as far as does the second electrical contact.

10. The electrical connector of claim 9, wherein the mating ends of the first and second electrical contacts extend farther beyond the mating face of the first leadframe assembly housing than does the mating end of the fourth electrical contact.

11. An electrical connector, comprising:

a connector housing, and a first leadframe assembly received in the connector housing in a first direction; and a second leadframe assembly received in the connector housing in the first direction, wherein (i) the first leadframe assembly defines an identical leadframe mating sequence with respect to the second leadframe assembly, and (ii) the first leadframe assembly is offset from the second leadframe assembly in the first direction.

12. The electrical connector of claim 11, wherein the leadframe mating sequence has at least two tiers.

13. The electrical connector of claim 11, wherein the leadframe mating sequence has at least three tiers.

14. The electrical connector of claim 11, wherein the connector housing includes a structure that is adapted to offset the first leadframe assembly from the second leadframe assembly.

15. The electrical connector of claim 14, wherein the structure includes a protrusion extending from the connector housing, the protrusion being adapted to prevent the first leadframe assembly from extending as far into the connector housing as the second leadframe assembly.

16. The electrical connector of claim 11, wherein each of the first and second leadframe assemblies includes a respective leadframe housing that defines a respective mating face and respective first and second electrical contacts that extend through the leadframe housing, and wherein a mating end of the first electrical contact in each leadframe assembly extends farther from the mating face of the leadframe housing than does a mating end of the second electrical contact.

17. The electrical connector of claim 16, wherein the first electrical contact of the first leadframe assembly is a ground contact and the second electrical contact of the first leadframe assembly is a signal contact.

18. The electrical connector of claim 17, wherein the first electrical contact of the second leadframe assembly is a signal contact.

19. The electrical connector of claim 18, wherein the mating end of the first electrical contact of the second leadframe assembly extends beyond the mating face of the first leadframe assembly housing as far as does the second electrical contact of the first leadframe assembly.

20. The electrical connector of claim 19, wherein the mating ends of the first and second electrical contacts of the first leadframe assembly extend farther beyond the mating face of the first leadframe assembly housing than does the mating end of the second electrical contact of the second leadframe assembly.

* * * * *